US008876497B2

(12) United States Patent
Kim

(10) Patent No.: US 8,876,497 B2
(45) Date of Patent: Nov. 4, 2014

(54) LINEAR COMPRESSOR

(75) Inventor: Jung-Hae Kim, Incheon (KR)

(73) Assignee: LG Electronics Inc., Seoul (KR)

( * ) Notice: Subject to any disclaimer, the term of this patent is extended or adjusted under 35 U.S.C. 154(b) by 524 days.

(21) Appl. No.: 12/739,057

(22) PCT Filed: Oct. 10, 2008

(86) PCT No.: PCT/KR2008/006000
§ 371 (c)(1),
(2), (4) Date: Apr. 21, 2010

(87) PCT Pub. No.: WO2009/054639
PCT Pub. Date: Apr. 30, 2009

(65) Prior Publication Data

US 2010/0260628 A1 Oct. 14, 2010

(30) Foreign Application Priority Data

Oct. 24, 2007 (KR) ..... 10-2007-0107373

(51) Int. Cl.

| | |
|---|---|
| ***F04B 17/04*** | (2006.01) |
| ***F04B 39/12*** | (2006.01) |
| ***F04B 53/00*** | (2006.01) |
| *F04B 17/03* | (2006.01) |

(52) U.S. Cl.
CPC ..... *F04B 39/122* (2013.01); *F04B 17/03* (2013.01); *F04B 53/003* (2013.01); *F04B 17/04* (2013.01)
USPC ..... 417/417; 417/416; 417/363; 417/415

(58) Field of Classification Search
CPC ..... F04B 17/04; F04B 17/03; F04B 53/003
USPC ..... 417/416, 415, 417, 363
See application file for complete search history.

(56) References Cited

U.S. PATENT DOCUMENTS

| | | | | |
|---|---|---|---|---|
| 3,143,281 | A * | 8/1964 | Dolz | 417/416 |
| 6,413,057 | B1 * | 7/2002 | Hong et al. | 417/416 |

(Continued)

FOREIGN PATENT DOCUMENTS

| | | |
|---|---|---|
| CN | 1877122 | 12/2006 |
| KR | 10-0382917 | 5/2003 |
| KR | 10-2005-0061955 | 6/2005 |
| KR | 10-0575812 | 5/2006 |

(Continued)

OTHER PUBLICATIONS

Chinese Office Action dated Dec. 23, 2011 with translation (200880113277.8).

(Continued)

*Primary Examiner* — Charles Freay
*Assistant Examiner* — Christopher Bobish
(74) *Attorney, Agent, or Firm* — KED & Associates, LLP

(57) ABSTRACT

A linear compressor is provided that includes a cylinder having a compression space for refrigerant therein, a piston that linearly reciprocates inside the cylinder in an axis direction to compress the refrigerant, and a frame having a mounting hole so that one end of the cylinder may be mounted thereon and a deformation prevention portion in some section around the mounting hole brought into contact with the one end of the cylinder. Even if a size of the cylinder is increased and a size of the frame limited, the frame is provided with enough strength to support the cylinder, thereby reducing fastening deformations and improving operation reliability.

10 Claims, 10 Drawing Sheets

(56) References Cited

U.S. PATENT DOCUMENTS

| | | | | |
|---|---|---|---|---|
| 6,881,042 | B2 * | 4/2005 | Heo et al. | 417/417 |
| 2004/0213681 | A1 | 10/2004 | Kim | |
| 2005/0142007 | A1 * | 6/2005 | Lee et al. | 417/415 |
| 2005/0186090 | A1 | 8/2005 | Park | |
| 2006/0280630 | A1 | 12/2006 | Lee et al. | |
| 2007/0009370 | A1 * | 1/2007 | Kim et al. | 417/417 |

FOREIGN PATENT DOCUMENTS

| | | | | |
|---|---|---|---|---|
| WO | WO 2004/081378 | | 9/2004 | |
| WO | WO 2005028867 | A1 * | 3/2005 | F04B 35/04 |

OTHER PUBLICATIONS

International Search Report issued in PCT/KR2008/006000 dated Mar. 3, 2010.

* cited by examiner

LINEAR COMPRESSOR

TECHNICAL FIELD

The present invention relates to a linear compressor, and more particularly, to a linear compressor which can maintain a strength of a frame even though a size of the frame is limited and a diameter of a cylinder is increased.

BACKGROUND ART

Generally, in a reciprocating compressor, a compression space to/from which an operation gas is sucked and discharged is defined between a piston and cylinder, so that the piston is linearly reciprocated inside the cylinder to compress refrigerant.

Since the reciprocating compressor includes a component for converting a rotation force of a driving motor into a linear reciprocation force of the piston, such as a crank shaft, a large mechanical loss occurs due to the motion conversion. Recently, a linear compressor has been actively developed to solve the foregoing problem.

In the linear compressor, particularly, a piston is connected directly to a linearly-reciprocated linear motor to prevent the mechanical loss by the motion conversion, improve the compression efficiency and simplify the configuration. Power inputted to the linear motor can be regulated to control the operation thereof. Accordingly, since the linear compressor can reduce noise more than the other compressors, it has been mostly applied to electric home appliances used indoors, such as a refrigerator.

FIG. 1 is a view illustrating an example of a conventional linear compressor.

In the conventional linear compressor, a structure composed of a frame 1, a cylinder 2, a piston 3, a suction valve 4, a discharge valve assembly 5, a linear motor 6, a motor cover 7, a supporter 8, a rear cover 9, main springs S1 and S2, a muffler assembly 10 and an oil supply device 20 is installed to be elastically supported inside a shell (not shown).

The cylinder 2 is fixedly fitted into the frame 1, the discharge valve assembly 5 composed of a discharge valve 5*a*, a discharge cap 5*b* and a discharge valve spring 5*c* is installed to block one end of the cylinder 2, the piston 3 is inserted into the cylinder 2, and the thin suction valve 4 is installed to open and close an outlet 3*a* of the piston 2.

In the linear motor 6, a permanent magnet 6*c* is installed to be linearly reciprocated, maintaining a gap between an inner stator 6*a* and an outer stator 6*b*. The permanent magnet 6*c* is connected to the piston 3 by a connection member 6*d*, and linearly reciprocated due to a mutual electromagnetic force between the inner stator 6*a*, the outer stator 6*b* and the permanent magnet 6*c* to thereby operate the piston 3.

The motor cover 7 supports the outer stator 6*b* in an axis direction to fix the outer stator 6*b*, and is bolt-fixed to the frame 1. The rear cover 9 is coupled to the motor cover 7. The supporter 8 connected to the other end of the piston 3 is installed between the motor cover 7 and the rear cover 9 to be elastically supported by the main springs S1 and S2 in an axis direction. The muffler assembly 10 for sucking refrigerant is fastened together with the supporter 8.

Here, the main springs S1 and S2 include four front springs S1 and four rear springs S2 in up-down and left-right positions symmetric around the supporter 8. When the linear motor 6 is operated, the front springs S1 and the rear springs S2 are driven in the opposite directions to buff the piston 3 and the supporter 8. Besides, refrigerant in a compression space P serves as a kind of gas spring to buff the piston 3 and the supporter 8.

The oil supply device 20 is composed of an oil supply tube 21, an oil pumping unit 22 and an oil valve assembly 23, and installed to communicate with an oil circulation passage (not shown) formed in the frame 1.

Therefore, when the linear motor 6 is operated, the piston 3 and the muffler assembly 10 connected thereto are linearly reciprocated. Since a pressure inside the compression space P is varied, the operations of the suction valve 4 and the discharge valve assembly 5 are automatically controlled. During the operation, refrigerant flows through a suction tube on the shell side, an opening portion of the rear cover 9, the muffler assembly 10 and an inlet 3*a* of the piston 3, is sucked into and compressed in the compression space P, and is externally discharged through the discharge cap 5*b*, a loop pipe and a discharge tube on the shell side.

Here, when vibration occurring due to the linear reciprocation of the piston 3 is transferred to the oil pumping unit 22, a pressure difference is generated by the oil pumping unit 22. Oil filled in the bottom of the shell is pumped through the oil supply tube 21 due to the pressure difference. The oil flows through the oil valve assembly 23, circulates along the oil circulation passage (not shown), and returns to the bottom of the shell. Such circulated oil serves to lubricate and cool components such as the cylinder 2 and the piston 3.

FIGS. 2 and 3 are views illustrating an example of the frame and the cylinder of the conventional linear compressor. The conventional frame 1 and cylinder 2 are insert-die-casted. In a state where the cylinder 2 is casted and inserted into a mold, the frame 1 is casted with Al. Here, the cylinder 2 is coupled to the center of the frame 1. A pair of holes 1*a* are formed in the frame 1 at both sides of the cylinder 2 to reduce an air resistance. An electric wire fetching groove 1*b* is provided to be open at one side of the frame 1 so that an electric wire connected to the linear motor 6 (refer to FIG. 1) can pass therethrough. Spring supporting portions 1*c* for supporting springs (not shown) for elastically supporting the structure are formed to protrude from both side lower portions of the frame 1. Besides, the oil circulation passage (not shown) for supplying oil to between the cylinder 2 and the piston 3 is defined in the frame 1. The oil supply tube 21 and the oil pumping unit 22 can be integrally formed with a lower portion of the frame 1, communicating with the oil circulation passage. The oil valve assembly 23 (refer to FIG. 1) can be individually bolt-fastened to the frame 1.

FIG. 4 is a graph showing fastening deformations of the frame and the cylinder of the conventional linear compressor. Referring to FIGS. 2 to 4, in a state where the frame 1 and the cylinder 2 are insert-die-casted, when radius direction distances from the center of the cylinder 2 are 5.65, 10, 63 and 68 mm, fastening deformations of the frame 1 and the cylinder 2 are shown. The more the radius direction distance from the center of the cylinder 2 increases, the more the fastening deformation of the frame 1 and the cylinder 2 increases in specific directions, i.e., directions of the holes 1*a* and the electric wire fetching groove 1*b*.

Accordingly, in the conventional linear compressor, when the size of the frame 1 is limited and the size of the cylinder 2 is increased, since the holes 1*a* are formed in portions of the frame 1 adjacent to the installation portion of the cylinder 2, structurally, a fastening portion 1 in of the frame 1 brought into contact with the cylinder 2 is too thin in consideration of the size of the cylinder 2. As a result, the strength of the frame 1 is reduced, so that the deformation of the frame 1 is transferred to the cylinder 2, causing a large fastening deformation thereto. When the piston 3 (refer to FIG. 1) is linearly reciprocated, the piston 3 (refer to FIG. 1) is brought into contact with the deformed cylinder 2, which results in low operation reliability.

DISCLOSURE OF INVENTION

Technical Problem

The present invention has been made to solve the above-described shortcomings occurring in the prior art, and an object of the present invention is to provide a linear compressor which can reduce a fastening deformation by reinforcing a fastening strength of a frame and a cylinder.

Technical Solution

According to the present invention for achieving the aforementioned object, there is provided a linear compressor, including: a cylinder having a compression space of refrigerant therein; a piston linearly reciprocated inside the cylinder in an axis direction to compress the refrigerant; and a frame having a mounting hole so that one end of the cylinder can be mounted thereon, and also having a deformation prevention portion in some section around the mounting hole brought into contact with the one end of the cylinder.

In addition, the frame includes a resistance reduction hole formed around the mounting hole to reduce an air resistance during the linear reciprocation of the piston, and the deformation prevention portion is positioned in a direction of the resistance reduction hole from the mounting hole.

Moreover, the deformation prevention portion protrudes in an axis direction.

Further, the frame and the cylinder are insert-die-casted.

Advantageous Effects

In the linear compressor according to the present invention, when the cylinder is coupled to the frame in an axis direction, the portion of the frame coupled to the cylinder is formed to be structurally thick in the axis direction. Therefore, even though the size of the frame is limited and the size of the cylinder is increased, since the fastening strength of the frame is reinforced, the fastening deformation of the frame and the cylinder and the deformation of the cylinder can be reduced. Consequently, while the piston operates, the piston less collides with the cylinder to thereby improve operation reliability.

MODE FOR THE INVENTION

Hereinafter, preferred embodiments of the present invention will be described in detail with reference to the accompanying drawings.

Figure 1:
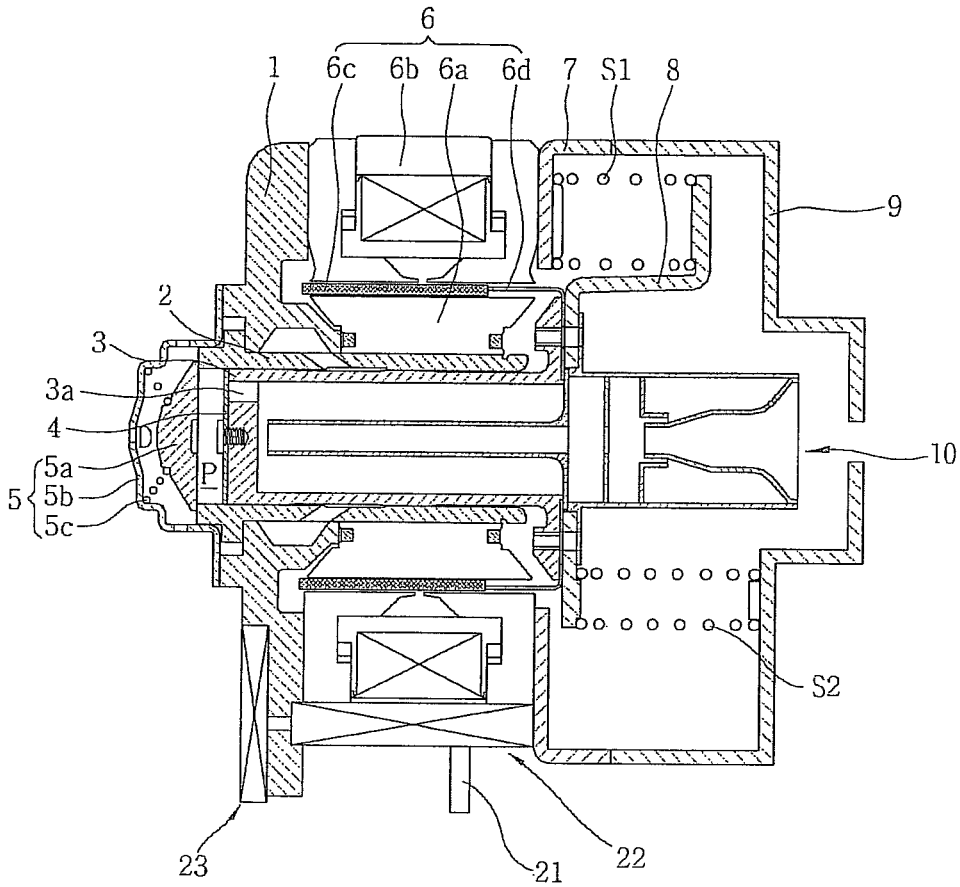
Fig. 1 Conventional Art
FIG. 1 is a view illustrating an example of a conventional linear compressor.
Figure 2:
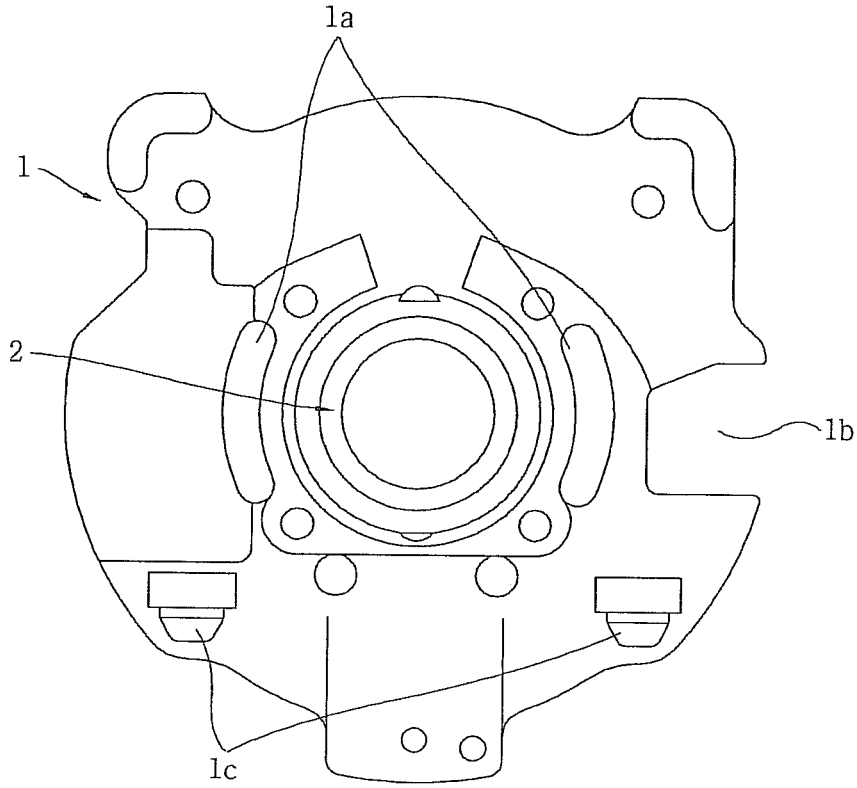
Fig. 2 Conventional Art
FIGS. 2 and 3 are views illustrating an example of a frame and a cylinder of the conventional linear compressor.
Figure 3:
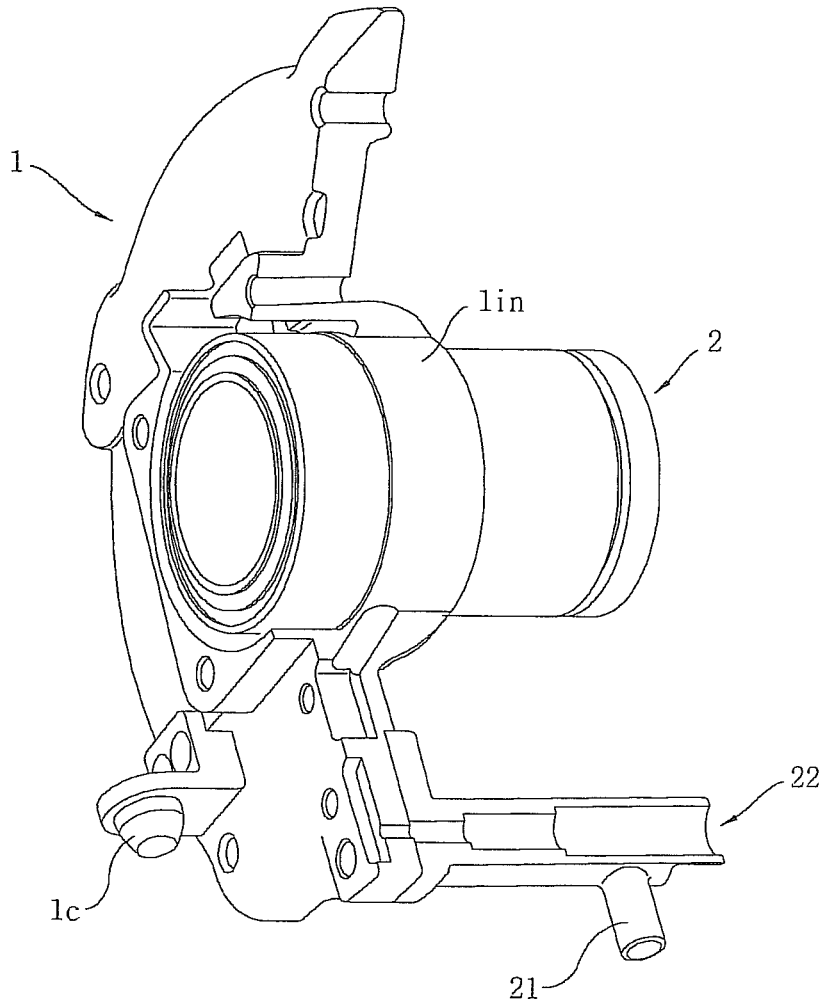
Fig. 3 Conventional Art
Figure 4:
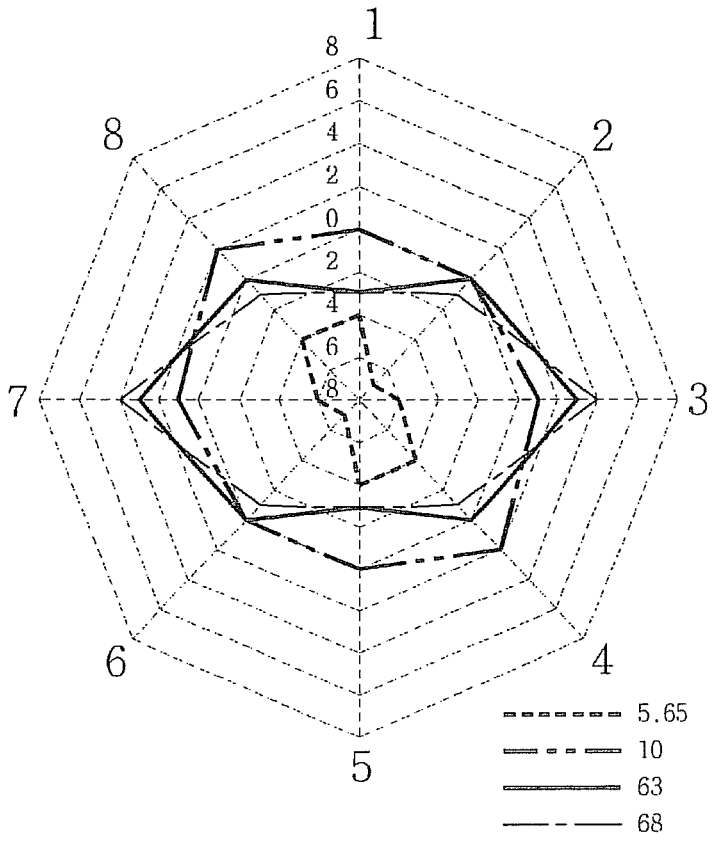
Fig. 4 Conventional Art
FIG. 4 is a graph showing fastening deformations of the frame and the cylinder of the conventional linear compressor.
Figure 5:
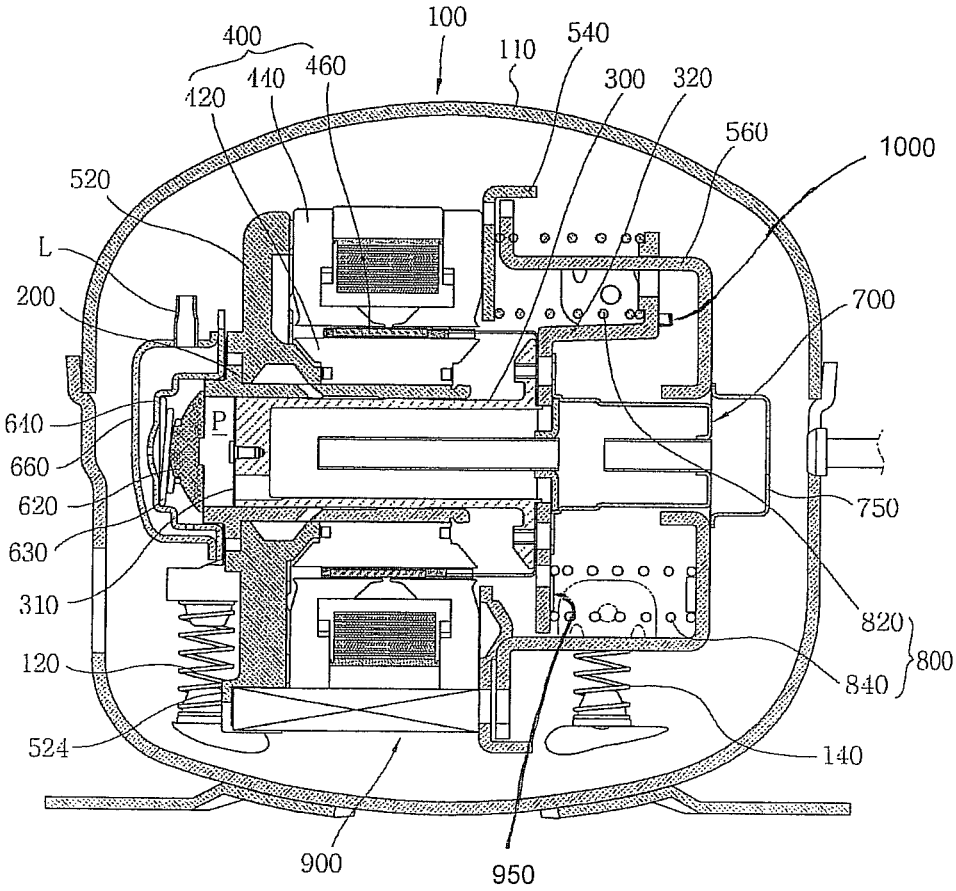
FIG. 5 is a view illustrating a linear compressor according to an embodiment of the present invention.

FIG. 5 is a view illustrating a linear compressor according to an embodiment of the present invention. The linear compressor 100 according to the present invention includes a cylinder 200, a piston 300, a linear motor 400 composed of an inner stator 420, an outer stator 440 and a permanent magnet 460, and an oil supply assembly 900 inside a shell 110 which is a hermetic container. When the permanent magnet 460 is linearly reciprocated between the inner stator 420 and the outer stator 440 due to a mutual electromagnetic force, the piston 300 connected to the permanent magnet 460 is linearly reciprocated together with the permanent magnet 460, and oil stored in the bottom of the shell 110 is pumped/supplied through the oil supply assembly 900 due to vibration of the piston 300 to thereby lubricate the cylinder 200 and the piston 300.

The inner stator 420 is fixed to an outer circumference of the cylinder 200, and the outer stator 440 is fixed by a frame 520 and a motor cover 540 in an axis direction. The frame 520 and the motor cover 540 are fastened to each other by means of a fastening member such as a bolt, so that the outer stator 440 is fixed between the frame 520 and the motor cover 540. The frame 520 can be integrally formed with the cylinder 200, or individually formed from the cylinder 200 and coupled to the cylinder 200. In the embodiment of FIG. 5, the frame 520 and the cylinder 200 are integrally formed.

A supporter 320 is connected to the back of the piston 300. Both ends of two front main springs 820 are supported by the supporter 320 and the motor cover 540. In addition, both ends of a single rear main spring 840 are supported by the supporter 320 and a rear cover 560. The rear cover 560 is coupled to the back of the motor cover 540. Here, a spring guider 950 is provided at the supporter 320 to prevent abrasion of the supporter 320 and enhance the supporting strength of the rear main spring 840. The spring guider 950 not only supports the rear main spring 840 but also guides the piston 300 and the rear main spring 840 to have the same center. Moreover, a suction muffler 700 is provided at the back of the piston 300. Refrigerant is introduced into the piston 300 through the suction muffler 700, thereby considerably suppressing refrigerant suction noise. At this time, the suction muffler 700 is positioned inside the rear main spring 840.

The piston 300 is hollowed so that the refrigerant introduced through the suction muffler 700 can be sucked into and compressed in a compression space P defined between the cylinder 200 and the piston 300. A valve 310 is installed at a front end of the piston 300. The valve 310 opens the front end of the piston 300 so as to allow the refrigerant to flow from the piston 300 to the compression space P, and blocks the front end of the piston 300 so as to prevent the refrigerant from returning from the compression space P to the piston 300.

When the refrigerant is compressed over a predetermined pressure in the compression space P by the piston 300, a discharge valve 620 positioned at a front end of the cylinder 200 is opened. The discharge valve 620 is installed inside a supporting cap 640 fixed to one end of the cylinder 200 to be elastically supported by a spiral discharge valve spring 630. The high pressure compressed refrigerant is transferred into a discharge cap 660 through a hole formed in the supporting cap 640, discharged to the outside of the linear compressor 100 through a loop pipe L, and circulated in a freezing cycle.

The respective components of the linear compressor 100 are supported by a front supporting spring 120 and a rear supporting spring 140 in an assembled state, and spaced apart from the bottom of the shell 110. Since the components are not in contact with the bottom of the shell 110, vibration generated in each component of the linear compressor 100 compressing the refrigerant is not transferred directly to the shell 110. Therefore, vibration transferred to the outside of the shell 110 and noise generated by vibration of the shell 110 can be remarkably reduced.

The linear compressor 100 has a stopped fixed member including the cylinder 200, and a linearly-reciprocated moving member including the piston 300. The linear compressor 100 is designed to adjust a resonance frequency fm of the system to a driving frequency fo of the linear motor 400. It can be varied by the front and rear supporting springs 120 and 140, the front and rear main springs 820 and 840, the gas spring, the fixed member and the moving member. However, in consideration of the axis direction linear reciprocation, the influence of the front and rear supporting springs 120 and 140 can be ignored.

$$f_m = \frac{1}{2\pi}\sqrt{\frac{(K_m + K_g)}{\left(\frac{M_s M_m}{Ms + M_m}\right)}} \qquad \text{Formula}$$

Accordingly, in the above formula, the resonance frequency fm of the system is varied by a rigidity Km of the front and rear main springs 820 and 840, a rigidity Kg of the gas spring, a mass Ms of the fixed member and a mass Mm of the moving member. Here, while the mass Ms of the fixed member is fixed to a constant, the rigidity Km of the front and rear main springs 820 and 840 has a certain dispersion, and the rigidity Ks Kg of the gas spring is changed according to the initial positions and load conditions of the front and rear main springs 820 and 840. Therefore, predetermined mass members 1000 are added to the moving member to change the mass Mm of the moving member, so that the resonance frequency fm of the system is adjusted to the driving frequency fo of the linear motor 400. At this time, the mass members 1000 are coupled to both side portions of the supporter 320 which do not overlap with the front and rear main springs 820 and 840 in an axis direction in order not to change the initial positions of the front and rear main springs 820 and 840.

Figure 6:
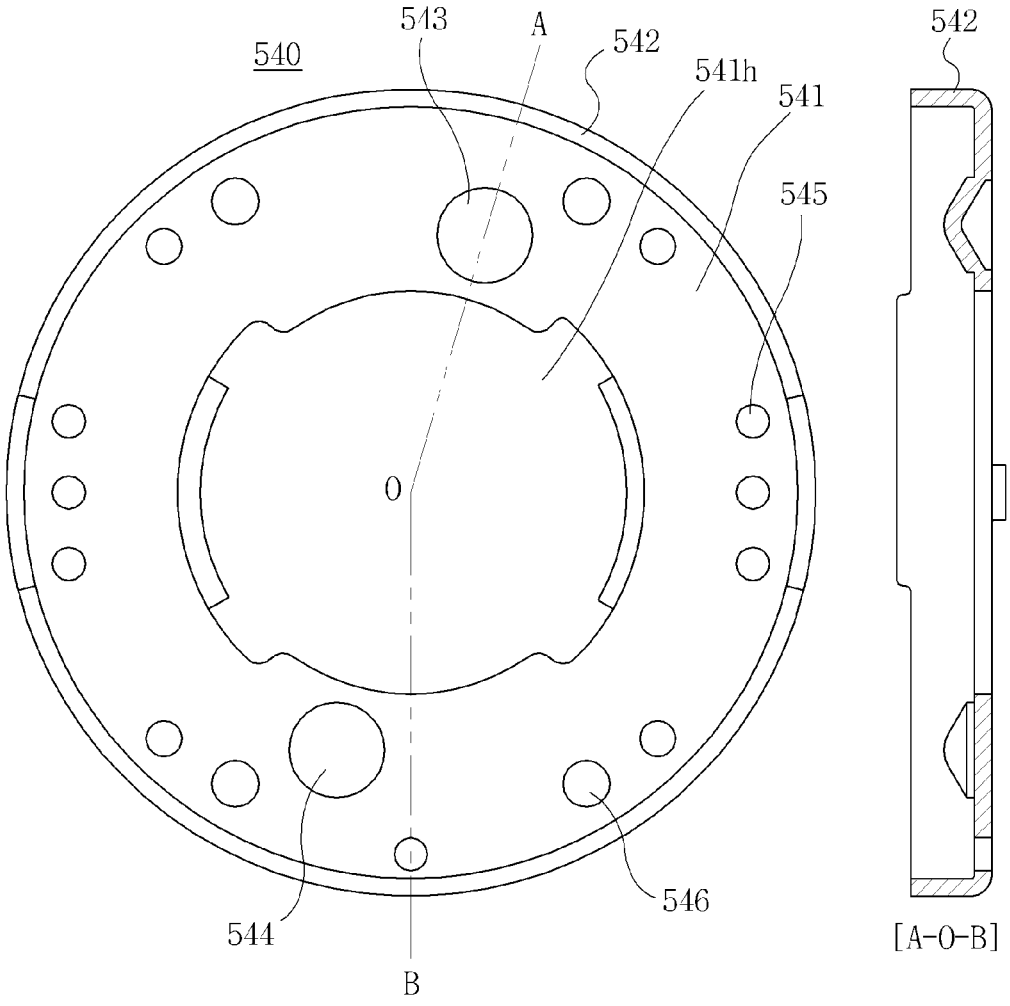
FIG. 6 is a view illustrating an example of a motor cover applied to FIG. 5.

FIG. 6 is a view illustrating an example of the motor cover applied to FIG. 5. The motor cover 540 includes an almost circular body 541 with a hole 541*h* so that the moving member composed of the piston 300 (refer to FIG. 5), the permanent magnet 460 (refer to FIG. 5), the supporter 320 (refer to FIG. 5) and the muffler 700 (refer to FIG. 5) can be linearly reciprocated through the motor cover 540. In addition, a bent portion 542 bent backward is formed along the outer circumference of the motor cover 540. The bent portion 542 enhances the supporting strength of the motor cover 540.

The center of the motor cover 540 corresponds to the center of the piston 300 (refer to FIG. 5). Two supporting protrusions 543 and 544 protruding backward to support the front main springs 820 (refer to FIG. 5) are formed in positions symmetric around the center. The supporting protrusions 543 and 544 support both ends of the front main springs 820 (refer to FIG. 5) with the supporter 320 (refer to FIG. 5). That is, the supporting protrusions 543 and 544 support the front ends (the other ends) of the front main springs 820 (refer to FIG. 5), and the supporter 320 (refer to FIG. 5) supports the rear ends (one ends) of the front main springs 820 (refer to FIG. 5).

In addition, a plurality of bolt holes 545 to be bolt-fastened to the rear cover 560 (refer to FIG. 5) and a plurality of bolt holes 546 to be bolt-fastened to the frame 520 are formed in both sides of the motor cover 540.

Figure 7:
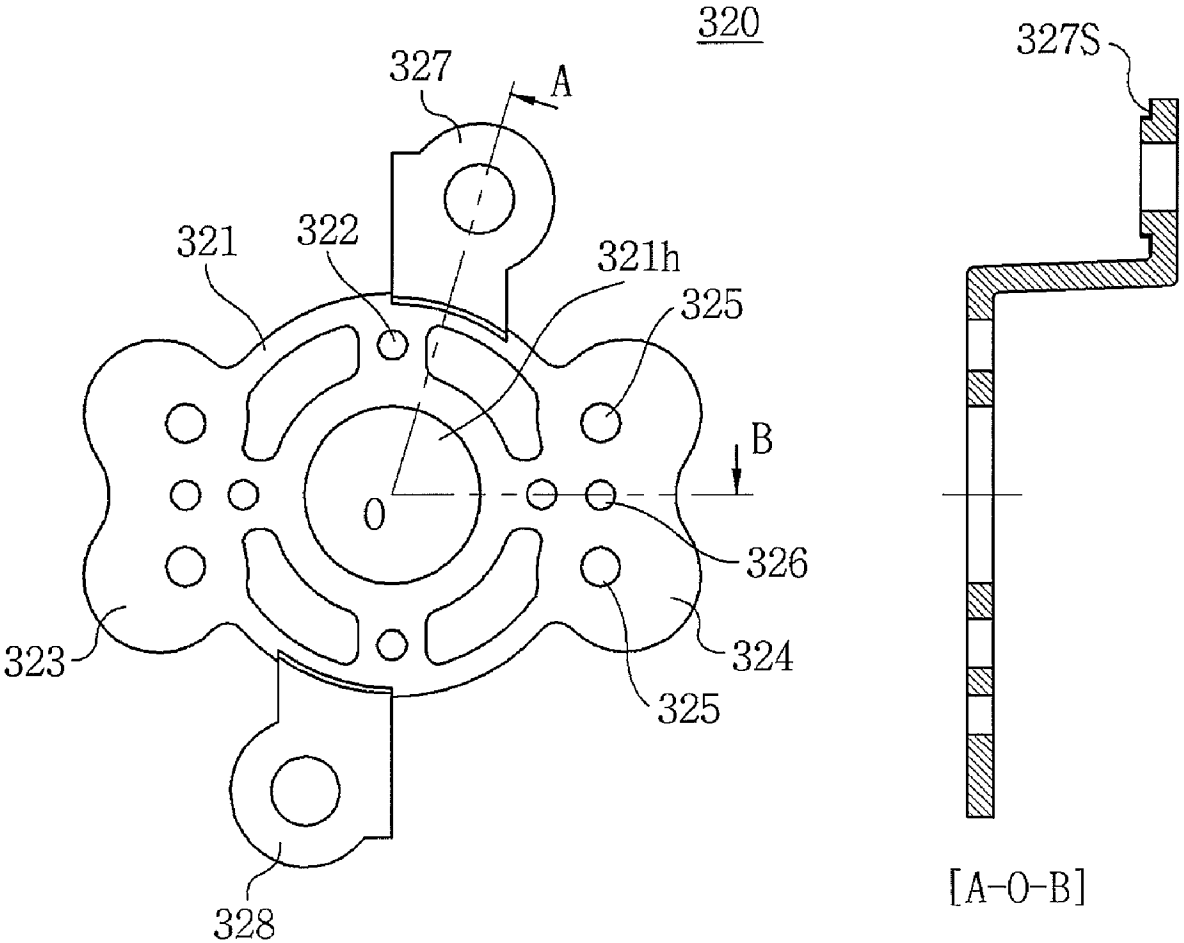
FIG. 7 is a view illustrating an example of a supporter applied to FIG. 5.

FIG. 7 is a view illustrating an example of the supporter applied to FIG. 5. The supporter 320 is coupled to the back of the piston 300 (refer to FIG. 5), and transfers a force from the main springs 820 and 840 (refer to FIG. 5) to the piston 300 (refer to FIG. 5) so that the piston 300 (refer to FIG. 5) can be linearly reciprocated in the resonance condition. A plurality of bolt holes 326 to be coupled to the piston 300 (refer to FIG. 5) are formed in the supporter 320.

The center of the supporter 320 is positioned corresponding to the center of the piston 300 (refer to FIG. 5). Preferably, a step difference is formed at a rear end of the piston 300 (refer to FIG. 5) so that the centers of the supporter 320 and the piston 300 (refer to FIG. 5) can be easily adjusted to each other. The supporter 320 includes an almost circular body 321. A hole 321*h* is formed in a central portion of the body 321 so that a part of the muffler 700 (refer to FIG. 5) can pass through the hole 321*h*. Guide portions 323 and 324 are formed at left and right portions of the body 321, respectively, and supporting portions 327 and 328 are formed at upper and lower portions thereof, respectively. A plurality of holes 322 are formed near the hole 321*h* of the body 321 of the supporter 320 so that the muffler 700 (refer to FIG. 5) can be bolt-fastened thereto at the back of the body 321 of the supporter 320. At this time, a front end of the rear main spring 840 (refer to FIG. 5) is supported at the spring guider 950 (refer to FIG. 5) positioned at the back of the body 321 of the supporter 320, and a rear end of the rear main spring 840 (refer to FIG. 5) is supported at the front of the rear cover 560 (refer to FIG. 5). The muffler 700 (refer to FIG. 5) is positioned inside the rear main spring 840 (refer to FIG. 5). [47] Moreover, the guide portions 323 and 324 of the supporter 320 are formed to expand from the left and right portions of the body 321 of the supporter 320. Two guide holes 325 are formed in the guide portions 323 and 324 to adjust the center of the spring guider 950 (refer to FIG. 5) to the center of the piston 300 (refer to FIG. 5), and one bolt hole 326 is formed between the guide holes 325 to bolt-fasten the spring guider 900 (refer to FIG. 5) thereto.

Further, the supporting portions 327 and 328 of the supporter 320 are formed at the upper and lower portions of the body 321 to be symmetric around the center of the supporter 320, respectively, and bent twice from the body 321. That is, the supporting portions 327 and 328 are bent backward from the body 321 once, and bent upward or downward from the back, respectively. The rear ends (one ends) of the front main springs 820 (refer to FIG. 5) are supported at the front of the supporting portions 327 and 328 of the supporter 320, and the front ends (the other ends) of the front main springs 820 (refer to FIG. 5) are supported at the back of the motor cover 540 (refer to FIG. 5).

As set forth herein, the number of the front main springs 820 (refer to FIG. 5) is reduced into two and the number of the rear main springs 840 (refer to FIG. 5) is reduced into one, which results in a low spring rigidity of the entire resonance system. In addition, when the number of the front main springs 820 (refer to FIG. 5) and the number of the rear main springs 840 (refer to FIG. 5) are reduced, respectively, the manufacturing cost of the main springs can be cut down.

Here, in a case where the rigidity of the front main springs 820 (refer to FIG. 5) and the rear main spring 840 (refer to FIG. 5) is reduced, when the mass of the driving unit such as the piston 300 (refer to FIG. 5), the supporter 320 and the permanent magnet 460 (refer to FIG. 5) is reduced, the driving unit can be driven in the resonance condition. Accordingly, the supporter 320 is manufactured of a non-ferrous metal having a lower density than a ferrous metal, instead of the ferrous metal. As a result, the mass of the driving unit is reduced, corresponding to the low rigidity of the front main springs 820 (refer to FIG. 5) and the rear main spring 840 (refer to FIG. 5), so that the driving unit can be driven in the resonance condition. For example, when the supporter 320 is manufactured of a non-magnetic metal such as Al, even if the piston 300 (refer to FIG. 5) is manufactured of a metal, the supporter 320 is not affected by the permanent magnet 460 (refer to FIG. 5). Therefore, the piston 300 (refer to FIG. 5) and the supporter 320 can be more easily coupled to each other.

When the supporter 320 is manufactured of a non-ferrous metal having a low density, it can satisfy the resonance condition and can be easily coupled to the piston 300 (refer to FIG. 5). However, the portions of the supporter 320 brought into contact with the front main springs 820 (refer to FIG. 5) are easily abraded due to friction against the front main springs 820 (refer to FIG. 5) during the driving. If the supporter 320 is abraded, the abraded pieces float in the refrigerant and circulate in the freezing cycle, which may damage the components existing on the freezing cycle. Thus, the portions 327S of the supporter 320 brought into contact with the front main springs 820 (refer to FIG. 5) are surface-processed. An NIP coating or anodizing treatment is carried out thereon so that a surface hardness of the portions 327S of the supporter 320 brought into contact with the front main spring 820 (refer to FIG. 5) can be higher than at least a hardness of the front main springs 820 (refer to FIG. 5). This configuration prevents the supporter 320 from being abraded into pieces due to the front main springs 820 (refer to FIG. 5).

Figure 8:
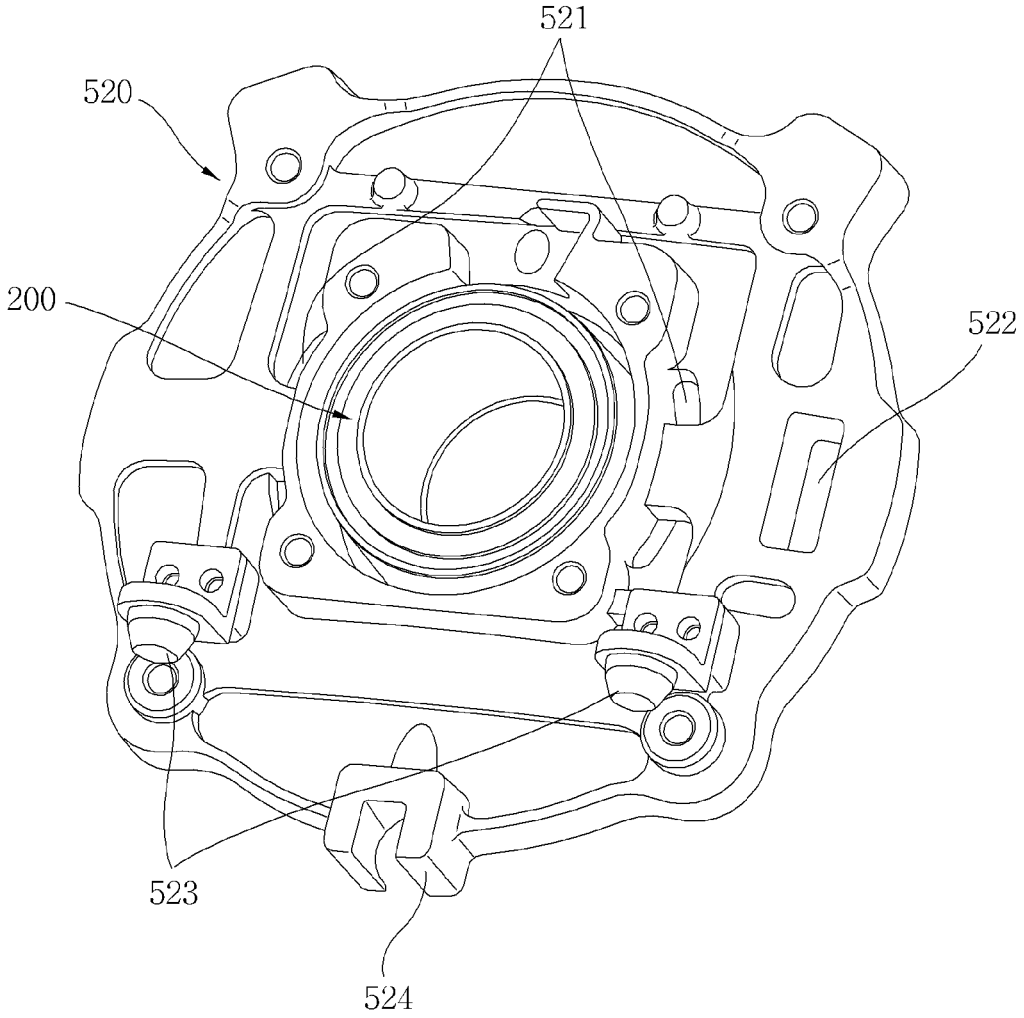
FIGS. 8 and 9 are views illustrating an example of a frame and a cylinder of the linear compressor according to the present invention.
Figure 9:
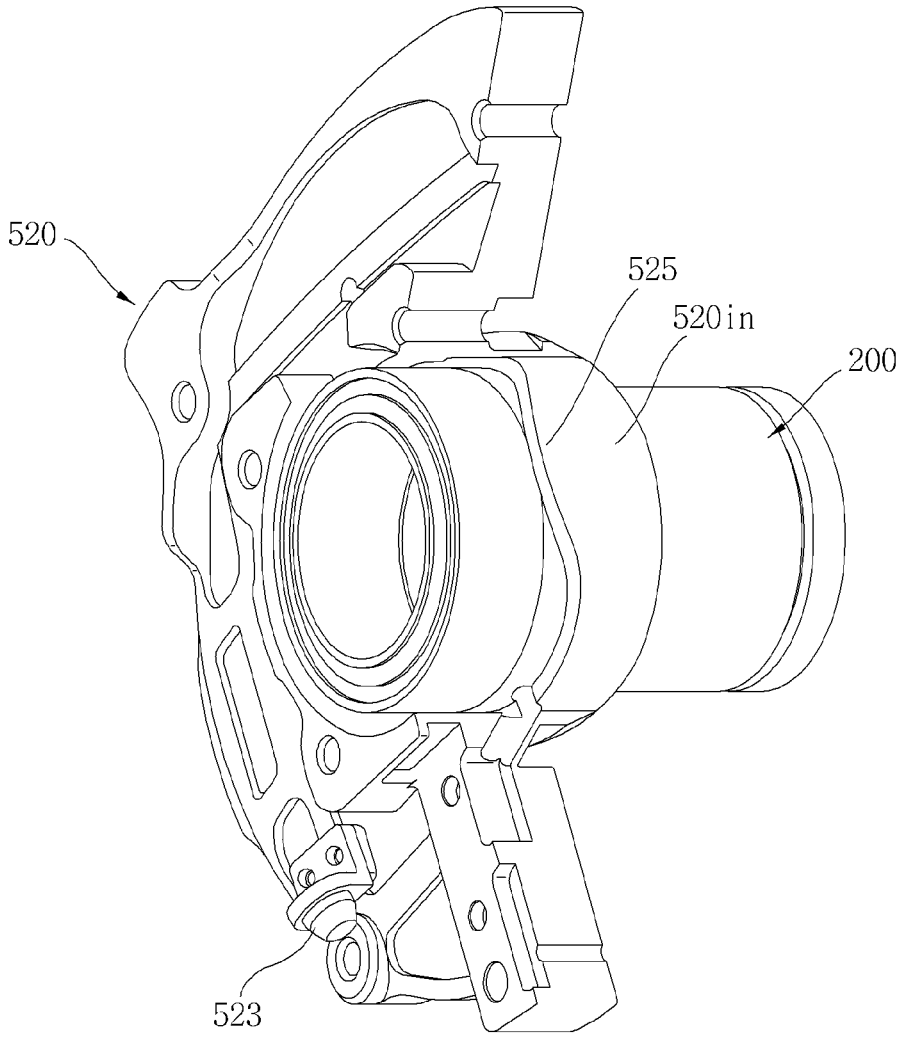

FIGS. 8 and 9 are views illustrating an example of the frame and the cylinder of the linear compressor according to the present invention. The cylinder 200 is casted. In a state where the cylinder 200 is inserted into a mold, the frame 520 is casted with Al and integrally manufactured with the cylinder 200 so that the cylinder 200 can be fixed to the center of the frame 520. Here, a pair of resistance reduction holes 521 for reducing an air resistance during the linear reciprocation of the piston 300 (refer to FIG. 5) are provided in the frame 520 at both sides of a mounting hole (not shown) where the cylinder 200 is to be mounted. An electric wire fetching hole 522 for fetching an electric wire (not shown) for supplying power to the linear motor (refer to FIG. 5) is provided at one side of the frame 520. A pair of spring supporting portions 523 which can support the supporting springs 120 and 140 (refer to FIG. 5) are provided at both side lower portions of the frame 520. A mounting groove on which the oil supply assembly 900 (refer to FIG. 5) can be mounted is provided at the bottom portion of the frame 520. The frame 520 has a continuous outer diameter. All the parts of the frame 520 except the electric wire fetching hole 522 are symmetric in both directions.

Particularly, a pair of deformation prevention portions 525 are formed at an inner portion between the resistance reduction holes 521 of the frame 520, i.e., at the fastening portion 520 in of the frame 520 brought into contact with the cylinder 200. The deformation prevention portions 525 protrude in an axis direction to be longer than the other part of the fastening portion 520 in, thereby structurally preventing fastening deformations of the frame 520. Here, the frame 520 includes an oil circulation passage (not shown) for supplying oil from the oil supply assembly 900 (refer to FIG. 5) to between the cylinder 200 and the piston 300 (not shown), and a groove (not shown) formed around the mounting hole to communicate with the oil circulation passage. The deformation prevention portions 525 are formed on the frame 520 without overlapping with the groove communicating with the oil circulation passage.

Accordingly, although the frame 520 is formed to be symmetric in both directions and provided with the resistance reduction holes 521 and the electric wire fetching hole 522, the deformation prevention portions 525 protruding more in an axis direction are formed at the fastening portion 520 in of the frame 520 brought into contact with the cylinder 200 to thereby reinforce the strength in the directions of the resistance reduction holes 521 and the electric wire fetching hole 522.

Figure 10:
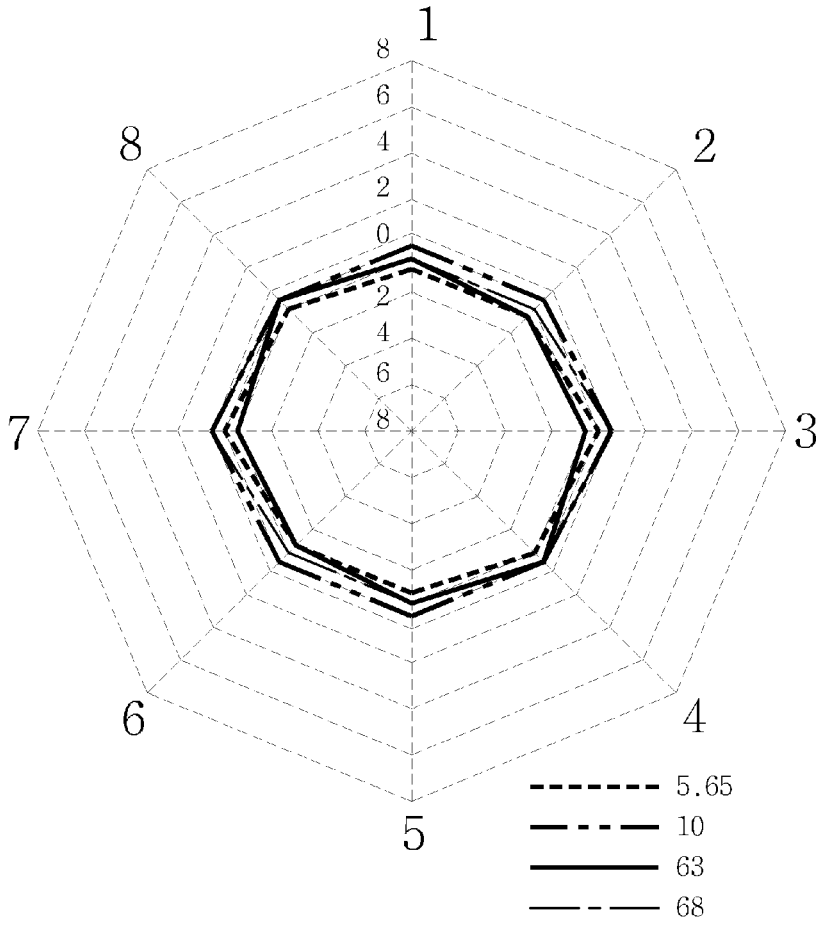
FIG. 10 is a graph showing fastening deformations of the frame and the cylinder of the linear compressor according to the present invention.

FIG. 10 is a graph showing fastening deformations of the frame and the cylinder of the linear compressor according to the present invention. Referring to FIGS. 8 to 10, in a state where the frame 520 and the cylinder 200 are insert-die-casted, when radius direction distances from the center of the cylinder 200 are 5.65, 10, 63 and 68 mm, fastening deformations of the frame 520 and the cylinder 200 are shown. Even though the radius direction distance from the center of the cylinder 200 increases, the fastening deformations of the frame 520 and the cylinder 200 are uniform in every direction. Compared with the prior art, the present invention considerably reduces the fastening deformation in the directions of the resistance reduction holes 521 and the electric wire fetching hole 522.

While the present invention has been illustrated and described in connection with the preferred embodiments and the accompanying drawings, the scope of the present invention is not limited thereto and is defined by the appended claims.

The invention claimed is:

1. A linear compressor, comprising:

a fixed member including a cylinder that provides a compression space for a refrigerant;

a moving member including a piston that compresses the refrigerant inside the cylinder, and a supporter comprising a central portion and a supporting portion that expands in a radius direction of the piston, the moving member being linearly reciprocated with respect to the fixed member;

a plurality of front main springs, each having one end supported at a front surface of the supporting portion of the supporter and the other end supported at the fixed member, and being positioned to be symmetric around the piston;

a rear main spring having one end supported at a rear surface of the central portion of the supporter and the other end supported at the fixed member; and a frame having a mounting hole in which one end of the cylinder is mounted, and having a fastening portion brought into contact with the cylinder, wherein the frame further includes an electric wiring hole provided at one side of the frame to supply power to a linear motor installed around the cylinder and at least one resistance reduction hole formed around the mounting hole to reduce air resistance during the linear reciprocation of the piston, and wherein a deformation prevention portion protrudes from the fastening portion in an axial direction longer than other parts of the fastening portion, only at an inner portion of the electric wiring hole or the at least one resistance reduction hole to reinforce a strength of the fastening portion of the frame in a side of the electric wiring hole or the at least one resistance reduction hole.

2. The linear compressor of claim 1, further comprising a plurality of mass members coupled to a rear surface of the supporter at a predetermined interval from an outer diameter of the rear main spring.

3. The linear compressor of claim 2, wherein the plurality of mass members is symmetric around the central portion of the supporter.

4. The linear compressor of claim 2, wherein the supporter comprises a plurality of guide holes that guides a coupling position of the supporter.

5. The linear compressor of claim 1, wherein the frame and the cylinder are insert-die-casted.

6. The linear compressor of claim 1, wherein the frame and the cylinder are integrally formed.

7. A linear compressor, comprising:

a cylinder having a compression space for a refrigerant therein;

a piston that linearly reciprocates inside the cylinder in an axis direction to compress the refrigerant; and a frame having a mounting hole in which one end of the cylinder is mounted, and having a fastening portion brought into contact with the cylinder, wherein the frame further includes an electric wiring hole provided at one side of the frame to supply power to a linear motor installed around the cylinder and at least one resistance reduction hole formed around the mounting hole to reduce air resistance during the linear reciprocation of the piston, and wherein a deformation prevention portion protrudes from the fastening portion in an axial direction longer than other parts of the fastening portion, only at an inner portion of the electric wiring hole or the at least one resistance reduction hole to reinforce a strength of the fastening portion of the frame in a side of the electric wiring hole or the at least one resistance reduction hole.

8. The linear compressor of claim 7, wherein the frame and the cylinder are insert-die-casted.

9. The linear compressor of claim 7, wherein the frame and the cylinder are integrally formed.

10. The linear compressor of claim 7, further comprising a supporter including a supporting portion that expands in a radius direction of the piston.

* * * * *